United States Patent [19]

Prosdocimo

[11] 4,393,676

[45] Jul. 19, 1983

[54] PROCESS FOR PRODUCING CONNECTING MEMBER SHANKS, SUCH AS HINGES FOR WINDOW AND DOOR FRAMES, FORMED OF CYLINDRICAL SECTIONS OF DIFFERENT DIAMETER, WITH CONTINUOUS EVEN SCREW THREAD, THAT IS WITH CONSTANT PITCH

[76] Inventor: Luciano Prosdocimo, Viale Grigoletti 73, Fontanafredda, Pordenone, Italy

[21] Appl. No.: 189,820

[22] Filed: Sep. 23, 1980

Related U.S. Application Data

[63] Continuation-in-part of Ser. No. 898,162, Apr. 20, 1978, abandoned.

[30] Foreign Application Priority Data

Jan. 31, 1978 [IT] Italy ..... 45704 A/78

[51] Int. Cl.[3] ..... B21H 3/02

[52] U.S. Cl. ..... 72/92; 72/103

[58] Field of Search ..... 72/88, 90, 92, 93, 103, 72/104, 94; 10/153

[56] References Cited

U.S. PATENT DOCUMENTS

| | | | |
|---|---|---|---|
| 2,232,337 | 2/1941 | Meersteiner | 72/88 |
| 2,382,019 | 8/1945 | Miller | 85/46 |
| 2,760,388 | 8/1956 | Seibert | 72/88 |
| 3,520,343 | 7/1970 | Evans | 85/46 |
| 3,538,525 | 11/1970 | Dupont | 10/27 R |

FOREIGN PATENT DOCUMENTS

| | | | |
|---|---|---|---|
| 479834 | 1/1952 | Canada | 10/27 E |
| 1140104 | 11/1962 | Fed. Rep. of Germany | 16/159 |
| 1559929 | 2/1970 | Fed. Rep. of Germany | 16/159 |
| 43-14101 | 6/1968 | Japan | 72/104 |
| 757864 | 9/1956 | United Kingdom | 16/159 |

*Primary Examiner*—Lowell A. Larson

*Attorney, Agent, or Firm*—Yount & Tarolli

[57] ABSTRACT

A process of producing a threaded shank, particularly for hinges, characterized by comprising in a succession the following steps of: cutting from a continuous wire a stock or cylindrical starting piece substantially having the same volume as the self-threading shank to be obtained; pressing said cylindrical piece at high pressure, to form a blank composed of a possible head section which will remain smooth, and at least two successive cylindrical sections of different diameter, each of which corresponding to the average diameter of the screw thread to be obtained and interconnected by a "frusto-conical" section having a thread pattern; and threading by rolling said blank with the thread connecting section constituting a guide means and continuity thread between the sections of different diameter.

3 Claims, 10 Drawing Figures

FIG.1
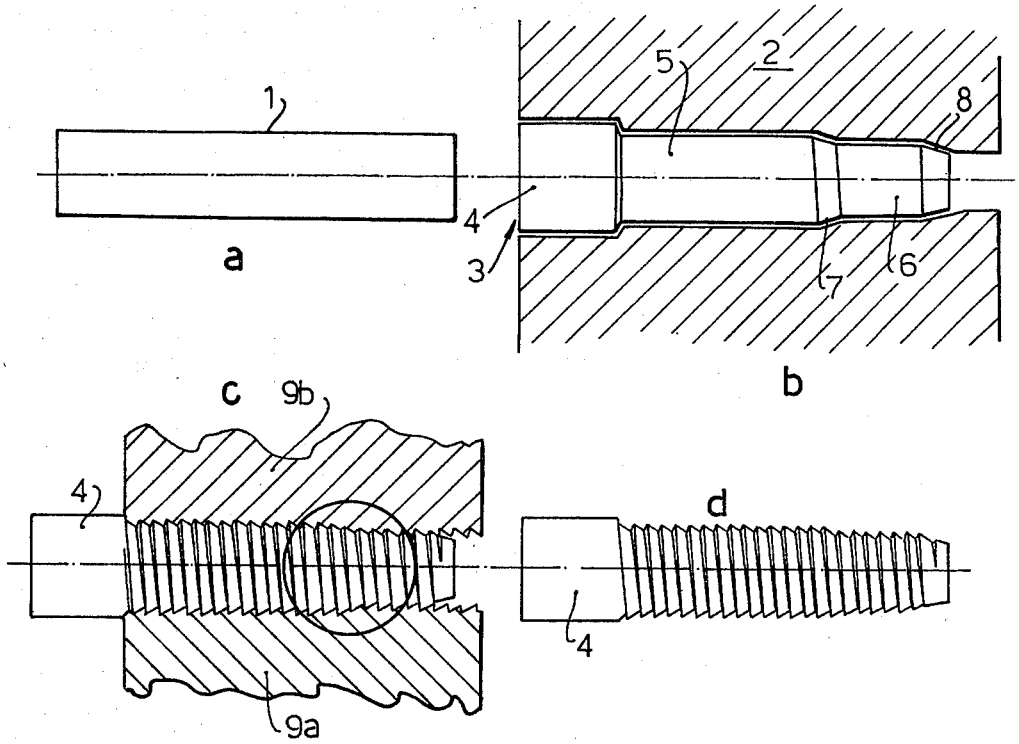
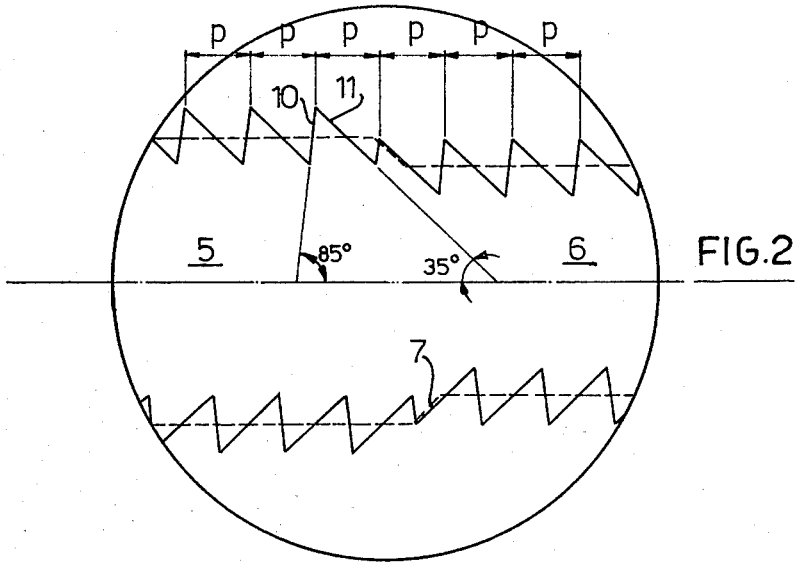
FIG.2

FIG. 3
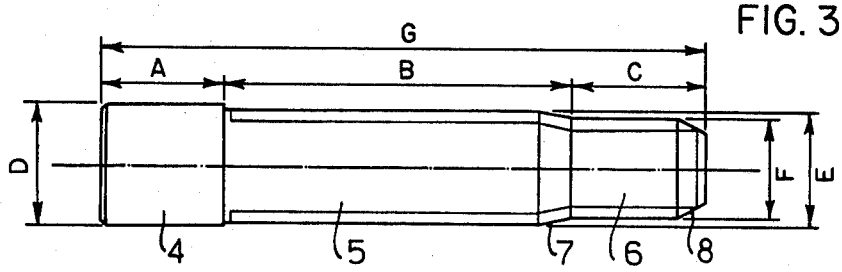
FIG.4
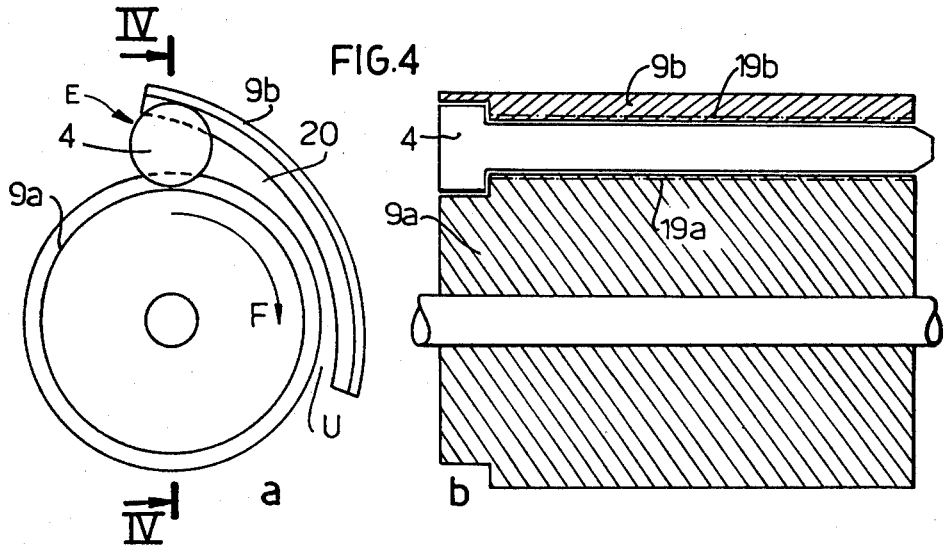
FIG.5
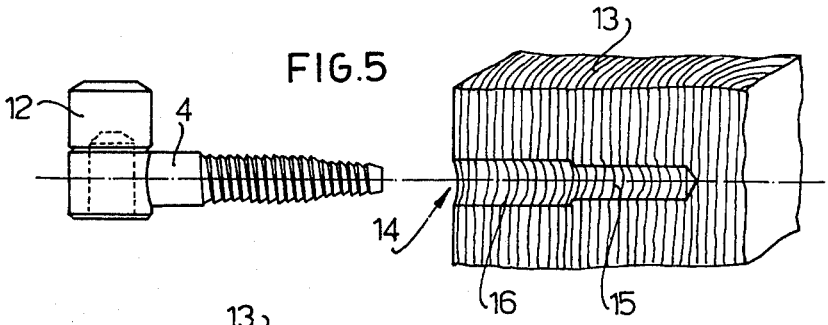
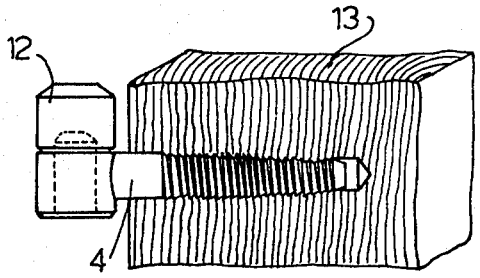
FIG.6

PROCESS FOR PRODUCING CONNECTING MEMBER SHANKS, SUCH AS HINGES FOR WINDOW AND DOOR FRAMES, FORMED OF CYLINDRICAL SECTIONS OF DIFFERENT DIAMETER, WITH CONTINUOUS EVEN SCREW THREAD, THAT IS WITH CONSTANT PITCH

The application is a continuation-in-part of U.S. Application Ser. No. 898,162, filed Apr. 20, 1978, titled "A PROCESS FOR MAKING SHANKS OF CONNECTING MEMBERS AND A HINGE PROVIDED BY SUCH A PROCESS" by Luciano Prosdocimo, now abandoned.

This invention relates to a process for producing threaded shanks for connecting members, such as hinges, which can be engaged by screwing in supports made of wood or similar materials. Such self-threading shanks should have an absolutely constant screw thread pitch, so that each of the threads penetrates into the seat provided by the tip thread, without shearing or anyhow crushing the wood. Where the shank has to be slightly unscrewed for small adjustments in the head or hinge portion connected thereto, the threads will be rearwardly shifted always in the same seats, without any nicking in the wood. Therefore, such shanks will allow an optimal grip or bite for the shank in a support, even after small adjustments.

Such self-threading shanks may be cylindrical, that is of a constant diameter, except for a possible smooth or unthreaded head, or may be composed of at least two cylindrical sections of different diameter. The cylindrical shanks are screw threaded by rolling operation simultaneously on the entire length and have a constant pitch, whereas the shanks composed of sections of different diameter cannot be screw threaded by rolling operation, but must be screw threaded by a turning tool which at the same time is caused to rotate and advance according to the longitudinal axis of the shank, successively providing the threads or turns for the screw thread, which results in a not strictly constant pitch on the whole screw thread and also a screw thread discontinuity between sections of different diameter. Moreover, the turning operation would involve a considerable waste of material.

It is the object of the present invention to provide a shank formed of sections of different diameter having a continuous even screw thread on the entire length, except for a possible smooth head.

A process for producing a threaded shank according to the present invention comprises in a sequence the steps of: cutting from a continuous wire an initial or starting stock or cylindrical piece having substantially the same volume as the self-threading shank to be obtained; pressing said cylindrical piece at high pressure so as to form a blank comprising at least two successive cylindrical sections of different diameter corresponding to the average diameters of the screw threads to be obtained and interconnected by a section having a thread pattern; and screw threading by rolling operation said blank with the thread connecting section acting as a guideway.

Further features and advantages of the invention will become apparent from the following detailed description, with reference to the accompanying drawings, given by mere way of unrestrictive example, in which:

FIG. 1 shows the successive operations for the process according to an embodiment of the present invention and particularly:

FIG. 1(*a*) shows an initial or starting piece,

FIG. 1(*b*) shows a blank composed of sections of different diameter,

FIG. 1(*c*) shows said blank during the screw threading operation by rolling and FIG. 1(*d*) shows the finished shank;

FIG. 2 shows on much enlarged scale the detail X of FIG. 1(*d*), with the blank drawn by dashed line;

FIG. 3 shows on enlarged scale the shank of FIG. 1(*d*), in which the relative dimensions are indicated;

FIG. 4 is a diagram of a known screw threading system by rolling, and particularly FIG. 4(*a*) is a front view and FIG. 4(*b*) is a sectional view taken along line IV—IV of FIG. 4(*a*);

FIG. 5 shows the shank according to the invention forming part of a hinge and the hole prepared therefor in a wood support; and FIG. 6 shows the hinge shank as screwed down in the wood support.

In the various figures of the drawings, the same reference numerals have been assumed to indicate corresponding parts.

The starting piece or small cylinder 1, shown in FIG. 1(*a*), may be provided by a roll of wire of the same diameter as the average diameter of the shank to be obtained, by cutting it in stocks or lengths of a same volume as that of the shank to be obtained. Said stock or small cylinder is introduced into a matrix or die 2 where it is pressed at high pressure in a blank 3, wherein the sections to be threaded are of the same diameter as the average diameter of the screw thread in the finished piece. Said matrix or die 2 has a pressing cavity corresponding to the shape of blank 3. In the embodiment shown, in addition to a head 4 which will remain smooth, said blank comprises two sections 5 and 6 of different diameter connected by a section 7 having the pattern of the thread to be obtained. The section 6 of minimum diameter is said tip section, whereas the section 5 is said intermediate section. A plurality of cylindrical intermediate sections of decreasing diameter from head to tip could be provided, as interconnected by sections having the pattern of a thread, which may be broadly referred to as "frusto-conical connections" or sloping connections. The blank 3 is then removed from the matrix or die 2 and is ready for threading by rolling.

Threading operation by rolling of a cylindrical piece is a process well known for many years, and may be of the type shown in FIG. 4. The system comprises two chasers of hardened steel, of which one of drum or roller type 9*a* rotating in the direction of arrow F, and the other of fixed mounted sector type 9*b*. Such chasers 9*a* and 9*b* have fluted surfaces 19*a* and 19*b* constituting the negative profile for a continuous even serrated screw thread, which is simultaneously carried out throughout the blank length, except for the head section 4 which remains smooth. This head section 4 may be used for supporting the shank during the threading operation. A gap 20 is defined between the two chasers, having a width decreasing in the direction of arrow F, that is to say from the inlet E to the outlet U of the shank to be threaded. The cylindrical shank to be threaded has a same diameter as the average diameter of the screw thread to be obtained, and is caused to rotate about its own longitudinal axis and at the same time is advanced in said gap 20, so as to turn by one revolution on itself from said inlet E to said outlet U. Thus, the shank is threaded by rolling, which causes an increase in outer diameter as a result of the material creep from the thread bottom to top. The chasers also could comprise two or more rollers juxtaposed and spaced apart by a distance corresponding to the shank diameter.

It is deemed unnecessary to go into further details about rolling to provide a screw thread on a cylindrical shank, being such a processing well known to those skilled in the art. Only by way of illustration reference is made to The British Encyclopedia under the item "SCREW—Methods of Cutting Screw Threads", and Grolier International Encyclopedia under the item "Screw and Bolt". In theory, such a system could also be adopted for threading shanks formed of sections of different diameter by designing chasers of corresponding diameter, but in practice an even screw thread was not obtained whereby, that is to say a screw thread having a constant pitch throughout the length. Thus, the driving chaser 9*a* has a different surface speed at the various sections of the shank, that is the section of chaser 9*a* of major diameter will rotate at a higher surface speed than that of the section of minor diameter. Only after extended studies, the applicant of the present invention has succeeded in threading by rolling a shank having sections of different diameter. First, it was required to adopt the sloping connecting section 7, having the thread pattern, which comes to rest against an abutment provided in the chasers during the rolling operation, maintaining the sections of different diameter spaced apart, and itself constituting continuity in the finished screw thread.

FIG. 2 clearly shows by dashed line the blank profile, and by full line the finished threaded shank. From this FIG. 2, it also clearly appears that the pitch p remains constant throughout the length. Secondly, the section of minor diameter should be shorter than the larger diameter section, so that the whole shank can be threaded in a single operation, there occurring a practically acceptable slight creep of the section of minor diameter. Therefore, a particular dimensioning for the shank parts is essential which, for the two section type of different diameter to be threaded and smooth head, shown in FIG. 3, referring to the diameter of the hinge to which it is attached or secured, is given by the following table:

| REF | A | B | C | D | E | F | G |
|---|---|---|---|---|---|---|---|
| 13 | 8 | 23 | 8 | 7.9 | 7.7 | 6.7 | 39 |
| 14 | 9 | 25 | 9 | 8.4 | 8.2 | 7.2 | 43 |
| 16 | 10 | 27 | 10 | 8.9 | 8.7 | 7.9 | 47 |
| 16F | 12 | 31 | 10 | 8.9 | 8.7 | 7.9 | 53 |
| 18 | 8 | 25 | 10 | 9.5 | 9.3 | 8.3 | 43 |
| 18F | 10 | 38 | 15 | 9.5 | 9.3 | 8.3 | 63 |
| 20 | 10 | 27 | 12 | 10 | 9.8 | 8.8 | 49 |
| 20F | 10 | 43 | 15 | 10 | 9.8 | 8.8 | 68 |
| 22 | 10 | 33 | 15 | 11.8 | 11.5 | 10.2 | 58 |
| 22F | 10 | 48 | 20 | 11.8 | 11.5 | 10.2 | 78 |

Preferably, as clearly shown in FIG. 2, the serrated profile is defined by a nearly radial rear surface 10 (as seen in the advancing direction in the shank introduction), that is inclined with respect to the longitudinal axis of the shank by an angle of 90° to 80°, preferably 85°, whereas the front surface 11 (still relative to the shank introduction direction) is inclined with respect to the longitudinal axis of the shank by an angle of 50° to 20°, preferably 35°. Also the connecting portion or section 7 has the same inclination as said front surface 11, as well as the tip end 8. The pitch p is the range of between 1.0 and 1.5 mm, preferably 22 revolution/inch. Since the pitch p is very small, the connecting section 7 may be considered as frusto-conical or sloping.

In FIG. 5, the shank thus produced is shown welded or anyhow secured to a hinge element 12. There is also partially shown in this FIG. 5 a support 13 made of wood or similar material, in which the shank is to be mounted. By a suitable perforating bit, a cylindrical stepped hole 14 is drilled in said wood support 13, this hole having inner and outer portions 15 and 16, respectively, which are interconnected, and wherein said portion 16 is of larger section than portion 15. Preferably, the inner hole portion 15 is of a diameter substantially equal to or slightly less than the inner diameter of the shank introduction section 6, and the outer hole portion 16 is of a diameter substantially equal to or slightly larger than the outer diameter of said introduction section 6. Moreover, the outer portion 16 is of a diameter equal to or slightly less than the inner diameter of the intermediate section 5, whereby the diameter of the intermediate section 5 is equal to or slightly larger than the outer diameter of the tip section 6. Therefore, the outer hole portion 16 is the centering guide for the introduction section 6, aiding in the shank screwing down in said hole 14.

When the shank is screwed down in said hole 14, the introduction section 6 starts to penetrate into the inner hole portion 15 almost simultaneously with the penetration of the intermediate section 5 into the outer hole portion 16. During screwing down operation, the sections 5 and 6 will self-thread the hole portions 15 and 16, respectively. When the intermediate section 5 arrives at the inner hole portion 15, the latter has a screw thread of the same pitch as provided by the introduction section 6, whereby the screwing down of the intermediate section 5 in the inner hole portion 15 is facilitated. Finally, on continued introduction of the shank into said hole 14, the smooth head section 4 penetrates into the previously threaded outer hole portion 16 and compresses the threads thereof. Thus, the shank is firmly adherent to the wall of hole 14 throughout the length thereof with resulting optimal grip.

It will clearly appear that, in the production of a shank having a plurality of intermediate sections, a multistep hole will be drilled in the wood support or the like, such steps defining hole portions dimensioned as above specified. Should it be required to unscrew the shank by a few turns, for example in hinge registering or adjustment, a good adherence between the shank and support will be still provided, and a slight clearance could occur only at the few unscrewing turns. Also the particular serrated configuration of the screw thread is a contribute in preventing any accidental withdrawal of the shank from the support in which it has been screwed down.

Of course, the inventive principle being unaltered, the construction details and embodiments can be broadly varied with respect to the above described and shown matter, without departing for this from the scope of the present invention, as defined by the following claims.

What is claimed is:

1. A method of forming a thread convolution with uniform pitch on a shank with at least two coaxial and essentially cylindrical portions of different diameters, the thread convolution on the shank being a leading face disposed at a first angle to the central axis of the shank, said method comprising the steps of providing a blank having two coaxial and essentially cylindrical portions connected by a sloping portion with the surface inclined at said first angle to the common axis of the two cylindrical portions, rolling said blank between a rotating chaser having two coaxial thread forming surfaces radially spaced apart by a distance equaling the difference in radius of said two different diameter portions of said blank and a fixed curved chaser having two thread forming surfaces radially spaced apart by a distance equal to the difference in the radius of said two different diameter portions of said blank, the larger diameter of said rotating chaser having a larger surface speed than the smaller diameter portion of said rotating chaser and being disposed in engagement with the smaller diameter portion of said blank, and guiding said blank during said rolling by abutting said sloping surface of said blank against sloping thread forming surfaces of said rotating chaser and said fixed chaser which connect said two thread forming surfaces of said rotating chaser and said fixed chaser, respectively, and which are parallel with said sloping surface of said blank to form a continuous uniform pitch thread convolution over and between the two essentially cylindrical portions of the blank.

2. A process according to claim 1, wherein said step of feeding the blank between chasers includes the step of forming a uniform continuous saw tooth screw thread having its leading face inclined relative to the central axis of the shank at an angle ranging between 20° and 50° and its trailing edge inclined relative to the central axis of the shank at an angle ranging from 80° to 90°.

3. The method as set forth in claim 2 wherein said step of threading said blank includes the step of forming a uniform continuous saw tooth thread having its leading face inclined at a 35° angle relative to the central axis of the shank and its trailing face inclined at an 85° angle relative to the central axis of the shank.

* * * * *